US006145619A

United States Patent [19]

Risser

[11] Patent Number: 6,145,619

[45] Date of Patent: Nov. 14, 2000

[54] FOLDABLE PERSONNEL BASKET FOR MOBILE EQUIPMENT

[75] Inventor: Philip E. Risser, Leota, Pa.

[73] Assignee: Aerial Innovations Incorporated, Reinholds, Pa.

[21] Appl. No.: 09/306,567

[22] Filed: May 6, 1999

[51] Int. Cl.[7] ..... E04G 1/26

[52] U.S. Cl. ..... 182/113; 182/2.1

[58] Field of Search ..... 182/113, 2.1, 150

[56] References Cited

U.S. PATENT DOCUMENTS

| | | | |
|---|---|---|---|
| 2,888,299 | 5/1959 | Balogh . | |
| 3,056,510 | 10/1962 | Garnett . | |
| 3,472,337 | 10/1969 | Atchey . | |
| 4,185,716 | 1/1980 | Rinehart | 182/113 |
| 4,467,888 | 8/1984 | Hickling | 182/113 |
| 4,520,898 | 6/1985 | Allemane | 182/113 |
| 4,852,690 | 8/1989 | Salmi . | |
| 4,962,827 | 10/1990 | Garnett . | |
| 5,381,872 | 1/1995 | Peruzzi et al. . | |
| 5,676,460 | 10/1997 | Biberstine | 182/113 |

*Primary Examiner*—Alvin Chin-Shue
*Attorney, Agent, or Firm*—Shlesinger Arkwright & Garvey, LLP

[57] ABSTRACT

A personnel basket for attachment to a boom or ladder of a rescue vehicle is provided, the basket having a pair of handrails extending along the perimeter of the personnel basket walls, the handrails are adapted to readily fold into a position that reduces the height of the basket and permits the basket to be stored on the cab of a rescue vehicle.

22 Claims, 9 Drawing Sheets

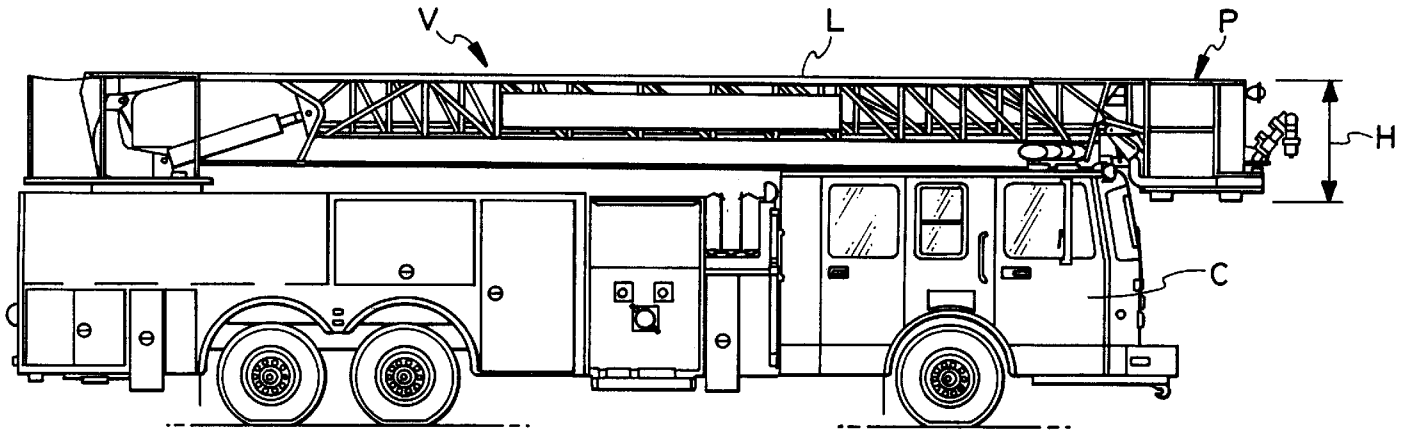
FIG. 2 - (Prior Art)
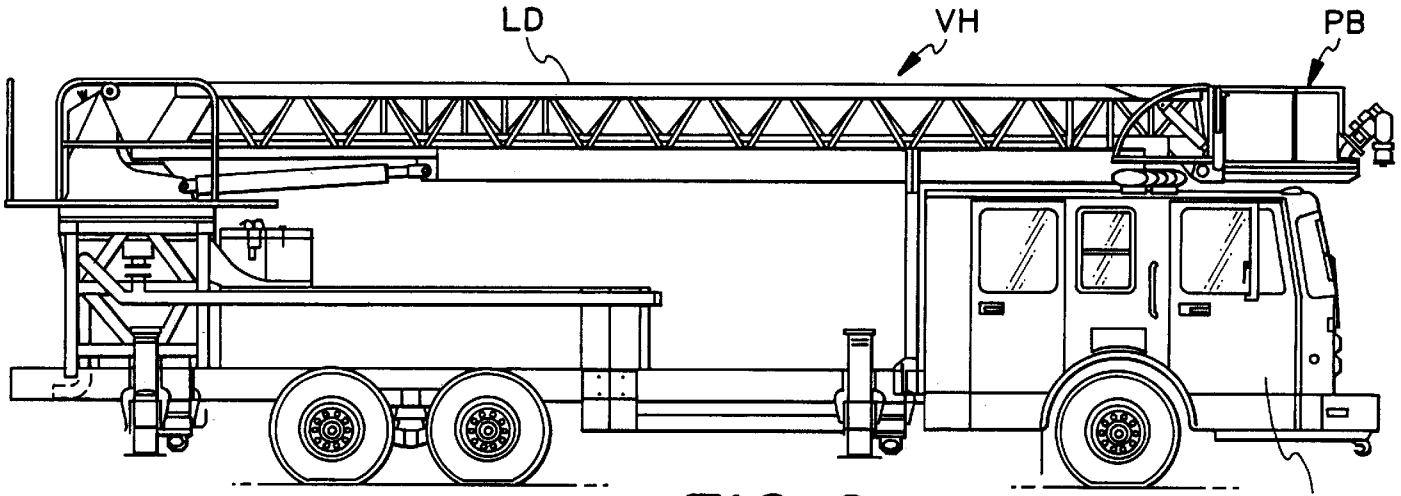
FIG. 9

FOLDABLE PERSONNEL BASKET FOR MOBILE EQUIPMENT

FIELD OF THE INVENTION

The present invention generally relates to fire-fighting and rescue equipment and in particular, vehicles having an extendable boom or ladder for providing access to elevated structures.

BACKGROUND OF THE INVENTION

Fire-fighting vehicles are often provided with an extendable and elevatable boom or ladder pivotally mounted to the vehicle. The ladder may further include a personnel basket at one end, the basket comprising a platform including handrails for safely conveying one or more individuals to and from a raised location. When in the retracted and stored position, the extension ladder is typically disposed on the top of the vehicle and extends from the rear of the vehicle to the driver's cab located at the front of the vehicle.

FIG. 2 illustrates one such prior art rescue vehicle V having an extendable ladder L including personnel basket P shown in a stored position on the top of the vehicle. As can be seen, the personnel basket must lie forward of the cab when in the stored position. The vertical height H of the basket prevents positioning of the basket on the top of the cab. That is, if positioned on the top of the cab, the vehicle will not be able to pass under bridges, underpasses or the like. Accordingly, the personal basket must be disposed forward of the vehicle cab which partially compromises the driver's line-of-sight. Interference with the driver's view is of course undesirable.

Representative prior art devices include that disclosed in U.S. Pat. No. 3,472,377; however, this device is positioned forward of the windshield of the vehicle and partially obscures the driver's view. U.S. Pat. No. 4,962,827 discloses a fire truck extension ladder having an operator platform wholly positioned behind a cab of the fire truck. As is apparent, this device reduces the amount of available space on the fire truck for rescue equipment and personnel. Finally, U.S. Pat. No. 3,056,510 discloses a collapsible personnel basket. This basket is positioned rearwardly of the vehicle which is inapposite the requirements of fire truck and rescue equipment.

In view of the above, a need has existed in the art for a personnel basket adapted to be disposed on the vehicle in a manner that will not interfere with the driver's view and also maintain the required vehicle clearance.

OBJECT AND SUMMARY OF THE INVENTION

It is an object of the present invention to provide a personnel basket that will not interfere with the vehicle driver's line-of-sight during travel;

Yet a further object of the present invention is to provide a personnel basket adapted to be positioned on the cab of a rescue vehicle while at the same time minimizing overall vehicle height.

Yet a further object of the present invention is to provide a personnel basket that will comply with safety standards requiring the hand rails of the rescue basket be higher than hand rails on the ladder to which the basket is attached.

A still further object of the present invention is to provide a personnel basket having foldable hand rails that may be quickly and easily extended and retracted thereby minimizing the time required for use of the device.

A still further object of the present invention is to provide a personnel basket wherein the hand rails are easily latched into place.

Yet another object of the present invention is to provide a personnel basket having foldable hand rails having a minimum amount of moving parts thereby reducing the likelihood of failure during use.

A still further object of the present invention is to provide a personnel basket having foldable handrails, the handrails also functioning as doors to permit access into and out of the personnel basket.

These and other objects of the present invention will be apparent from the following description taken together with the drawings.

In summary, the present invention is directed to a personnel basket comprising a platform, the platform having a front wall, rear wall and side wall sections cooperating to form an enclosed interior region, the front wall, rear wall and at least one of said side walls provided with at least one integrated handrail extending continuously therealong and hingedly secured to only the at least one of the side walls whereby the portion of the handrail adjacent the at least one side wall is adapted to be moved into a folded position about the at least one side wall to a position substantially perpendicular thereto and the portion of the handrail adjacent the front and rear wall is moved to a position parallel thereto.

BRIEF DESCRIPTION OF THE DRAWINGS

FIG. 2 is a side-elevational view of a PRIOR ART personnel basket in the stored position on a fire-fighting vehicle;

FIG. 9 is a side-elevational view of a rescue vehicle incorporating the personnel basket according to the present invention and showing the personnel basket in a folded and stored position on the vehicle cab;

DETAILED DESCRIPTION OF THE PREFERRED EMBODIMENTS

Figure 1:
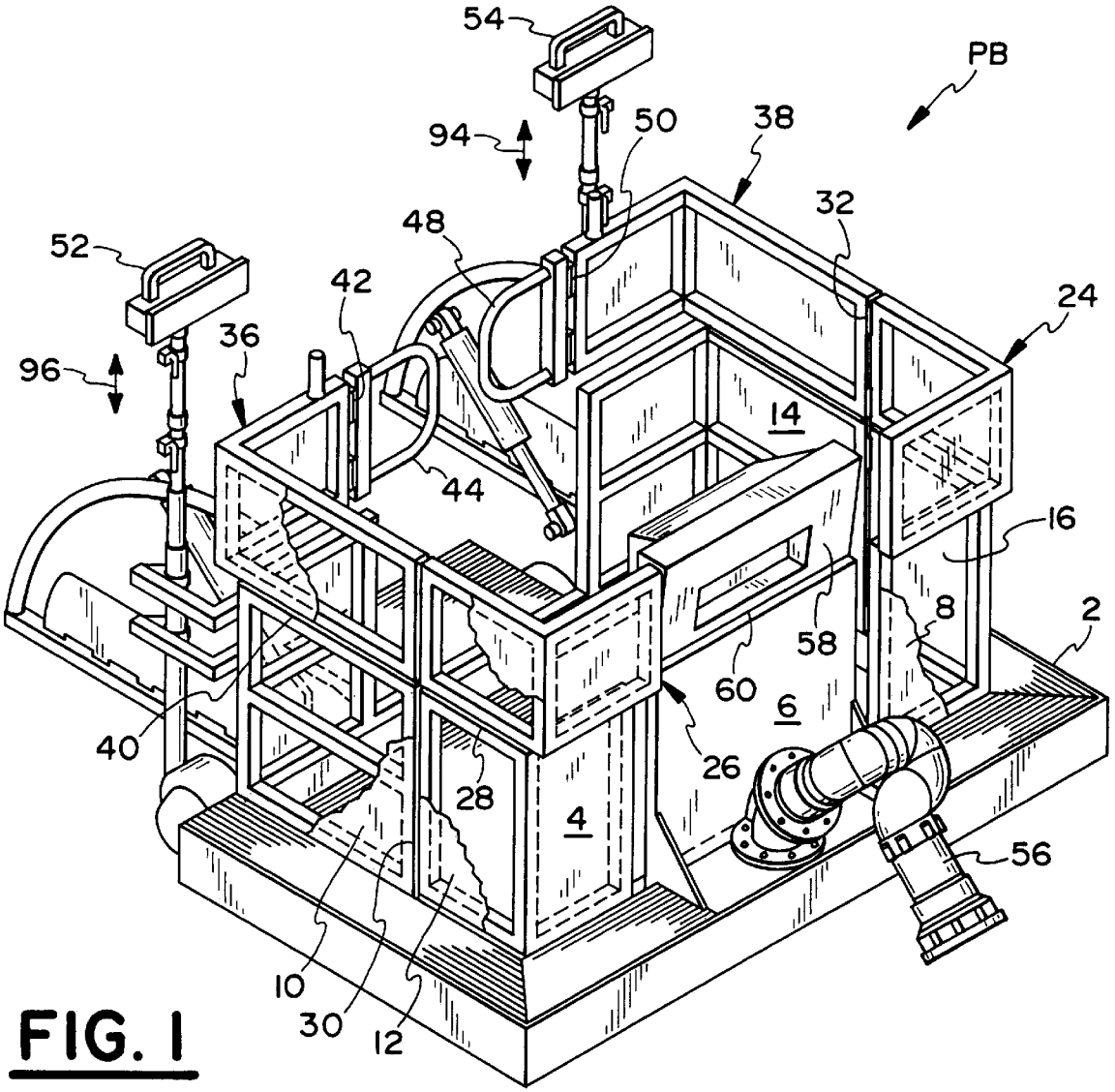
FIG. 1 is a front perspective view of the personnel basket according to the present invention showing the handrails in an upright position and with portions of the panels broken away.
Figure 3:
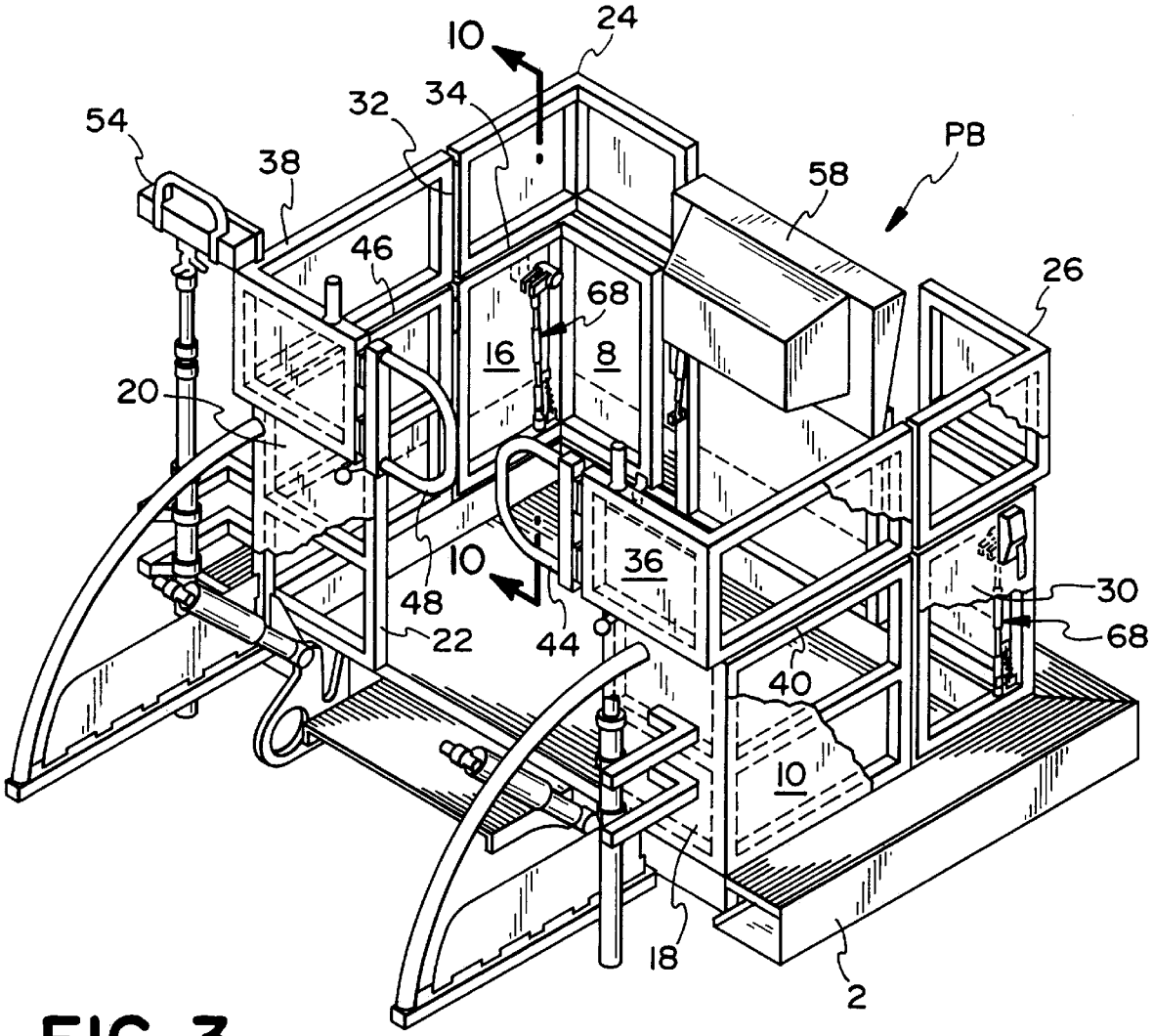
FIG. 3 is a rear perspective view of the personnel basket shown in FIG. 1 with portions of one of the search lights and the nozzle broken away.

FIGS. 1 and 3 show the personnel basket PB according to the present invention with all handrails in an unfolded or fully extended position and generally comprising a platform 2 having four interconnected walls sections enclosing an interior region. The front of the personnel basket PB includes front panels and frame assemblies 4, 6, and 8. The bottom of the frame associated with central front panel 6 is firmly secured or bolted to platform 2. Front panel and frame assemblies 4 and 8 are coextensive with side panel surfaces 12 and 16 respectively, and each of which comprise a portion the side walls of the personnel basket PB. As is apparent, the front and side panels (including underlying frame assemblies) 4,12 and 8,16 are shown as part of a single frame assembly forming right angles at the front corners of the personnel basket PB.

Additional side panels 10 and 14 including underlying frame assemblies are provided and shown in the figures to be coextensive with rear panels 20 and 18 respectively. These rear and side panels (including frame assemblies) 10,20 and 14,18 are part of a single frame assembly forming a pair of rear corners of the personnel basket PB. The rear and side panels 10,20 and 14,18 (including frame assemblies) are firmly secured to the platform 2 by bolting or other securing device. As is apparent, panels 10 and 20 including frame assemblies may be formed separately rather than as a joint unit.

An edge surface 30 extending between the respective frame assemblies of side panels 12 and 10 includes a hinge (not shown) interconnecting the same and allowing the corner assembly formed by panels 12 and 4 to rotate inwardly. An edge 32 extending between the respective frame assemblies of side panels 14 and 16 is likewise provided with a hinge (not shown) to permit the corner assembly formed by panels 8 and 16 to rotate inwardly.

The construction materials selected for the various panels and frame assemblies include those known in the art for fire-fighting equipment such as alloy metals or the like.

Extending upwardly from each of the above noted panels are a pair of generally U-shaped handrails. A first handrail is formed by the interconnection of rear corner section 38 and front corner section 24. A second handrail is formed by the interconnection of rear corner section 36 and front corner section 26. The first and second handrails together with the vertically disposed control panel 58 thereby provide an effective railing extending around the perimeter of the personnel basket PB.

Each of these rear and front corner sections are shown to comprise panel and frame assemblies similar to that described earlier with respect to the panels forming the various front, rear and side walls. In addition, edges 30 and 32 extend between corner sections 36 and 26, and 24 and 38 respectively. These edges include hinges which interconnect the respective sections and permit the sections to rotate inwardly about the hinges as will be further explained below.

An additional edge surface 28 extends between a bottom frame edge of the side of front corner handrail 26 and a top frame edge of side panel 12, the edge surface 28 including a hinge (not shown). The front (including underlying frame) of the front corner handrail 26 does not lie in the same plane as front panel 4. This offset arrangement permits the front corner 26 of the handrail to be folded against the exterior surface of panel 4 in a manner as will further explained below. A edge surface 34 (including hinge) is likewise provided between a bottom frame edge of the side of the opposite front corner handrail 24 and a top frame edge of the corresponding side panel 16. Further, the front (including underlying frame) of the front corner handrail 24 is offset and does not lie in the same plane as front panel 8 so as to permit the handrail to be folded against panel 8.

The rear corner sections 36 and 38 are similarly connected to the respective underlying panels and frame assemblies. An edge surface 40 (including hinge) is provided between the bottom frame edge of the side of rear corner handrail 36 and a top frame edge of the corresponding side panel 10. The rear facing panel (including underlying frame) of the rear corner section 36 is offset from and does not lie in the same plane as rear panel 20. Edge surface 46 (including hinge) is provided between the bottom frame edge of the side of rear corner handrail 38 and a top frame edge of the corresponding rear panel 18. In the same manner as on the opposite side, rear facing panel (including underlying frame) of the rear corner section 38 is offset from and does not lie in the same plane as rear panel 18.

A further hinge interconnection is provided between the respective front and rear corner handrail sections. In particular, earlier noted edge surfaces 30 and 32 also extend between front and rear corner handrail sections 36 and 36 and between front and rear corner handrails sections 24 and 38 respectively.

Rear corner hand rail section 36 is provided with a U-shaped door rail 44 hingedly connecting about edge 42. The opposite rear corner hand rail section 38 likewise is provided with a door rail 48 hingedly secured about edge 50.

Lights 52 and 54 are telescopically retractable and extendable in the direction shown by arrows 94 and 96. A water-hose nozzle or outlet 56 is also included and the control panel 58 is shown hingedly secured to front panel 6 along edge 60. The platform 2 is fixed or otherwise secured to the end of a boom or ladder in the known manner and will include the various hydraulics and related instrumentation for positioning and control of the platform relative to the ladder. Attaching and securing the personnel basket PB and platform 2 to the end of a ladder or boom may achieved in any of a variety of ways known to one of ordinary skill and any such embodiments are within the scope of the present invention including modification to the positioning of fire-hose nozzle 56, search lights 54 and the various construction materials used in fabrication of the platform.

Figure 4:
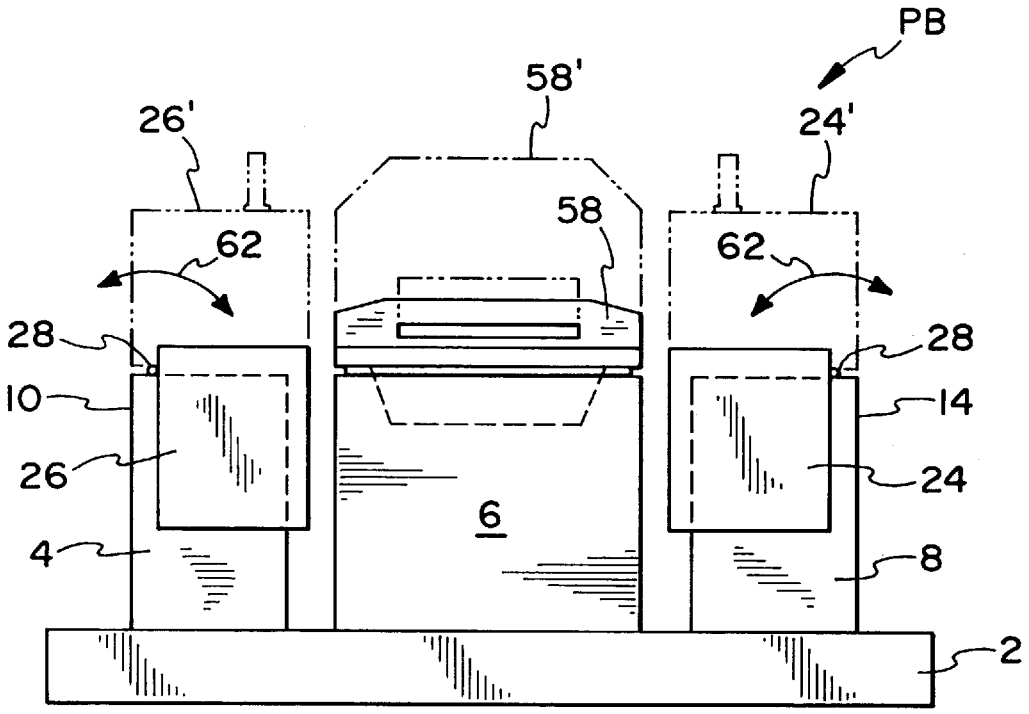
FIG. 4 is a front-elevational view of the device of FIG. 8A with the ladder, lights and nozzle broken away and including phantom lines showing the position of the handrails when in an upright position.
Figure 5:
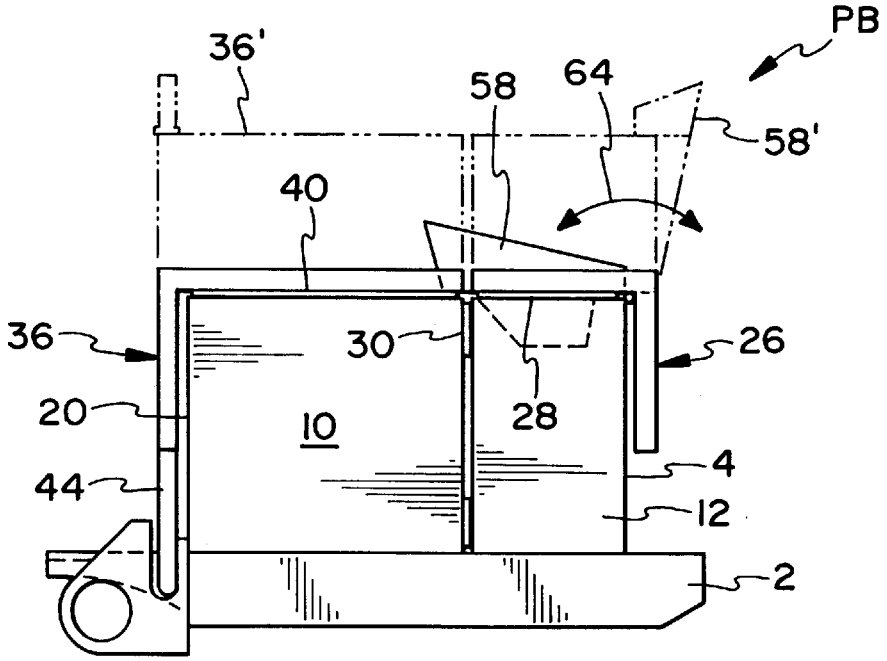
FIG. 5 is a side-elevational view of the device of FIG. 8A with the ladder, light and nozzle broken away and including phantom lines showing the position of the handrails when in an upright position.
Figure 6:
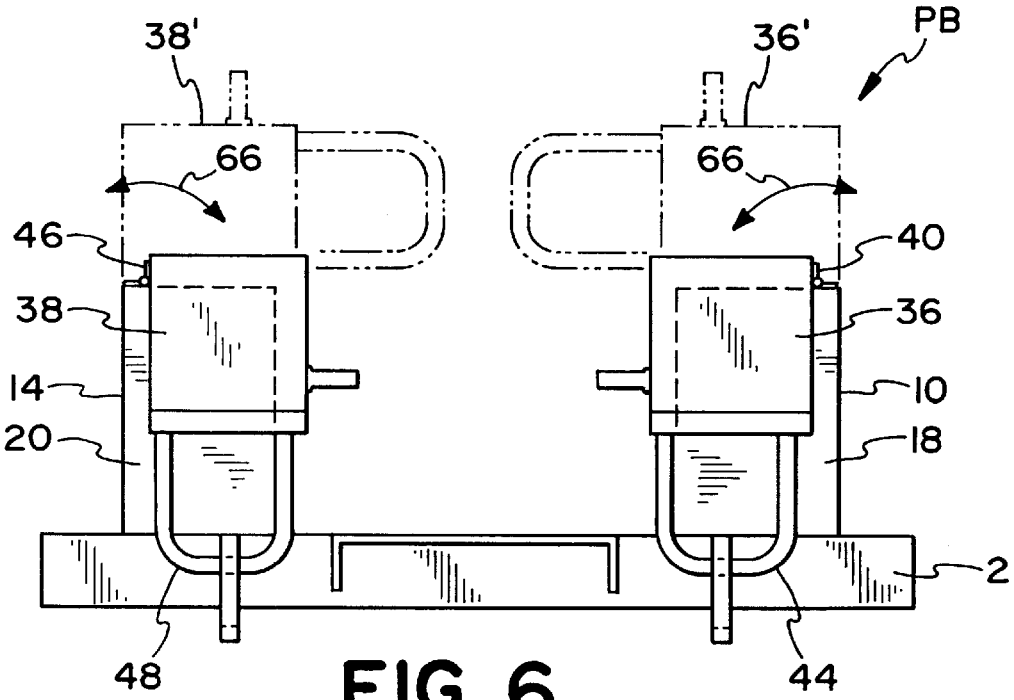
FIG. 6 is rear-elevational view of the device of FIG. 8A with the ladder, light and nozzle broken away and including phantom lines indicating the positioning of the handrails when in a upright position.

Turning to FIGS. 4, 5, and 6, the personnel basket PB is shown in a fully folded position with phantom lines and arrows indicating the unfolded or extended positions for the front corner handrails 24 and 26, the control panel 58 and rear handrails 36 and 38. FIG. 4 is a front view of the personnel basket PB when in a folded position. In particular, the front corner handrail 24 and the front corner handrail 26 are shown in a position whereby they are rotated about respective hinges 28 approximately 90° and in the direction of arrows 62 from their upright or unfolded position shown in phantom lines as 24' and 26'. Control panel 58 is likewise shown folded about hinge edge 60 from its upstanding position 58' shown in phantom lines.

FIG. 5 shows rear corner handrail section 36 fully folded about a hinge (not shown) disposed along edge 40 and interconnecting handrail section 36 to side panel 10. The upright or unfolded position of the rear corner handrail section 36 is shown in phantom lines as 36'. Arrow 64 indicates the range of movement of the control panel from a folded to an upright or unfolded position 58' in phantom lines.

Figure 8A:
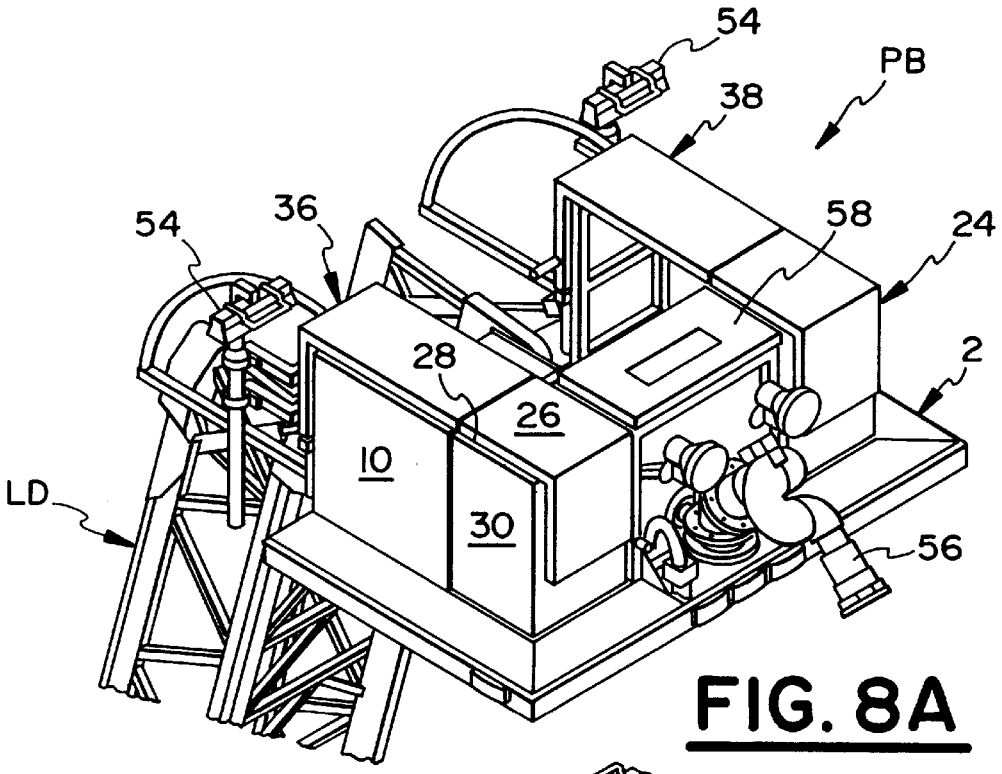
FIG. 8A is a front perspective of the personnel basket according to the present invention showing the handrails folded, search lights retracted and with portions of the ladder broken away.

FIG. 6 is a rear elevational view of the personnel basket shown in FIG. 5 and in particular, illustrates the folded position for rear corner handrails 36 and 38. The hinges provided along edge surfaces 46 and 40 attached each of the rear corner handrails 36 and 38 to their respective panels and provide approximately 90° rotation from the folded position to the unfolded position indicate at 36' and 38' and along a path indicated by arrows 66. The fully folded position shown in each of FIGS. 4, 5 and 6 are best illustrated in FIG. 8A where each of front corner handrails 24 and 26 and rear corner handrails 36 and 38 are shown in a folded position reducing the overall height of the personnel basket.

Figure 7:
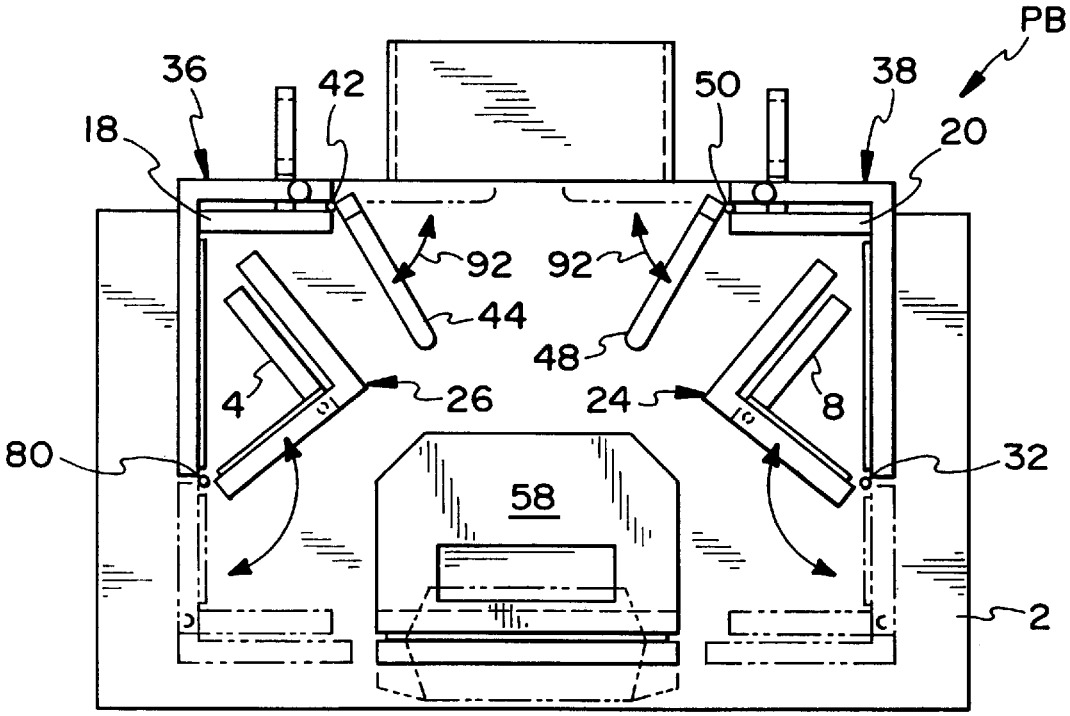
FIG. 7 is a top-elevational view of the device shown in FIG. 8C with the ladder, lights and nozzle broken away and including phantom lines indicating the position of the front access doors and rear door rails when closed.
Figure 8B:
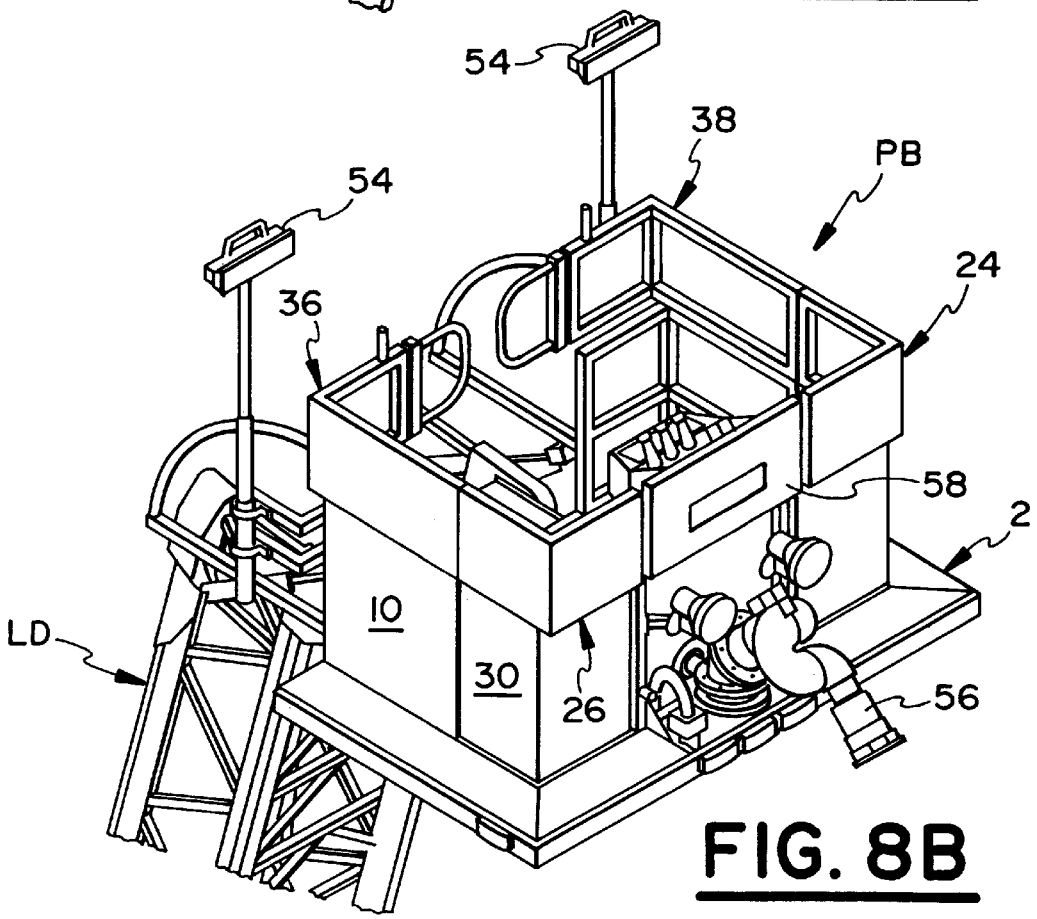
FIG. 8B is a front perspective of the personnel basket according to the present invention showing the handrails and search lights fully extended and with portions of the ladder broken away.
Figure 8C:
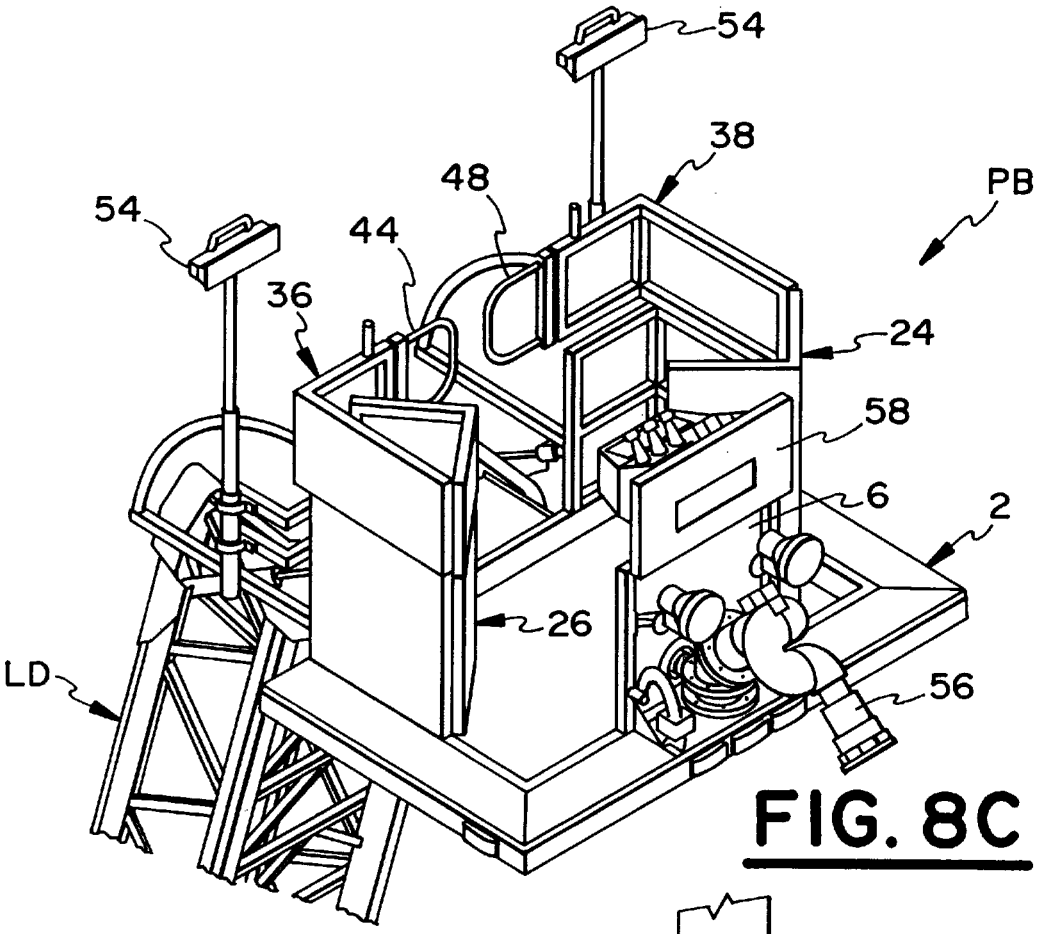
FIG. 8C is a front perspective of the personnel basket according to the present invention showing the handrails fully extended and the front access doors in an open position and with portions of the ladder broken away.
Figure 11A:
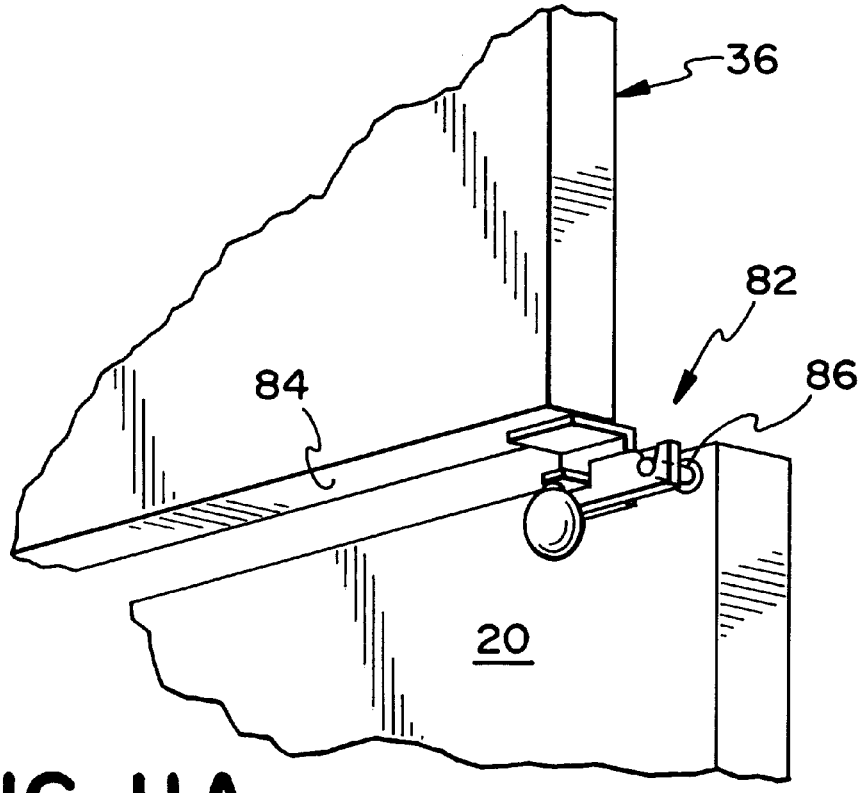
FIGS. 11A and 11B show the rotary latch and knob mechanism according to the present invention when in a locked and unlocked position respectively.
Figure 11B:
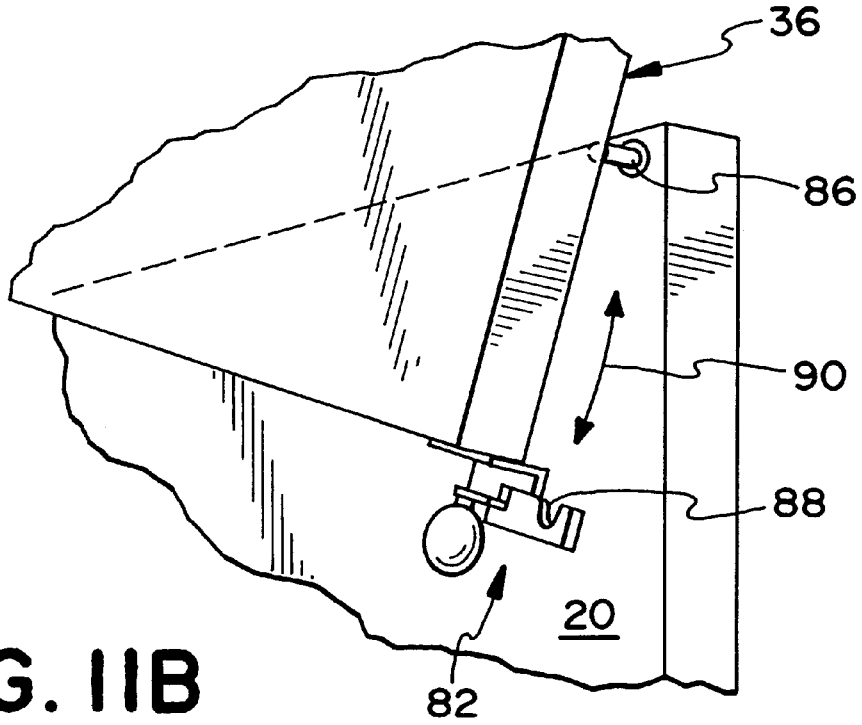

FIG. 7 and FIG. 8C jointly illustrate the movement of the front corner handrails 24 and 26 when locked into engagement with their corresponding front panels and side panels to form a pair of pivoting front doorways providing access to and from the personnel basket PB from the front. The locking may be accomplished by way of a rotary latch and knob mechanism 82 as shown in FIGS. 11A and 11B with respect to the rear panel of rear corner handrail 38 to the underlying panel and frame 20. In particular, the latching mechanism will include a latch bolt and cooperating rotary latch that engages and disengages in the known manner to secure the respective panel sections and provide a pivoting front doorway structure adapted to rotate about hinges extending along the length of edges 30 and 32. The above latching mechanism is applicable for interlocking each corner handrail 24, 26, 36, and 38 to the respective panel and frame member positioned beneath it. As is apparent, it is within the scope of the present invention to provide other locking mechanisms so long as the panels are rigidly secured when in a locked position.

Figure 10A:
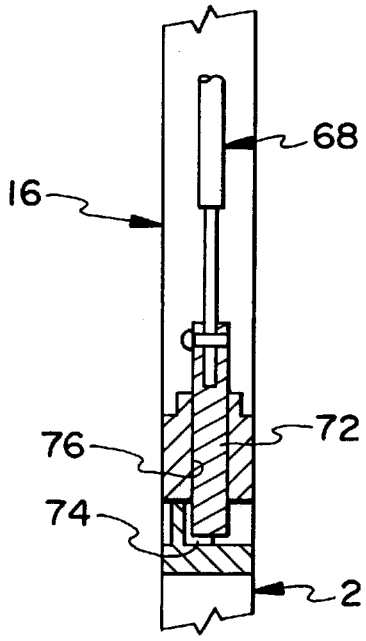
FIG. 10A is a partial sectional view of the front access door latch mechanism when in a locked position and taken along lines 10A—10A of FIG. 10.
Figure 10B:
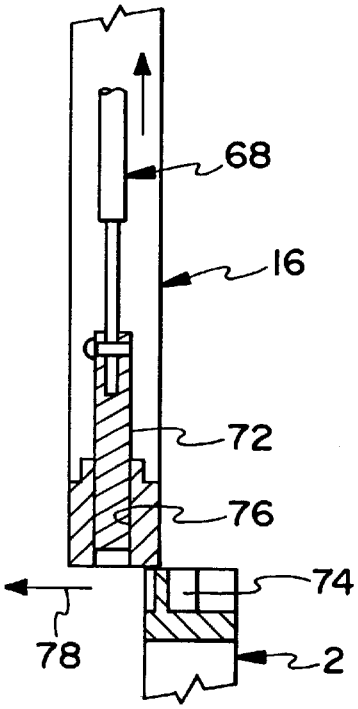
FIG. 10B is the front access door latch mechanism shown in FIG. 10A when in an unlocked position.
Figure 10:
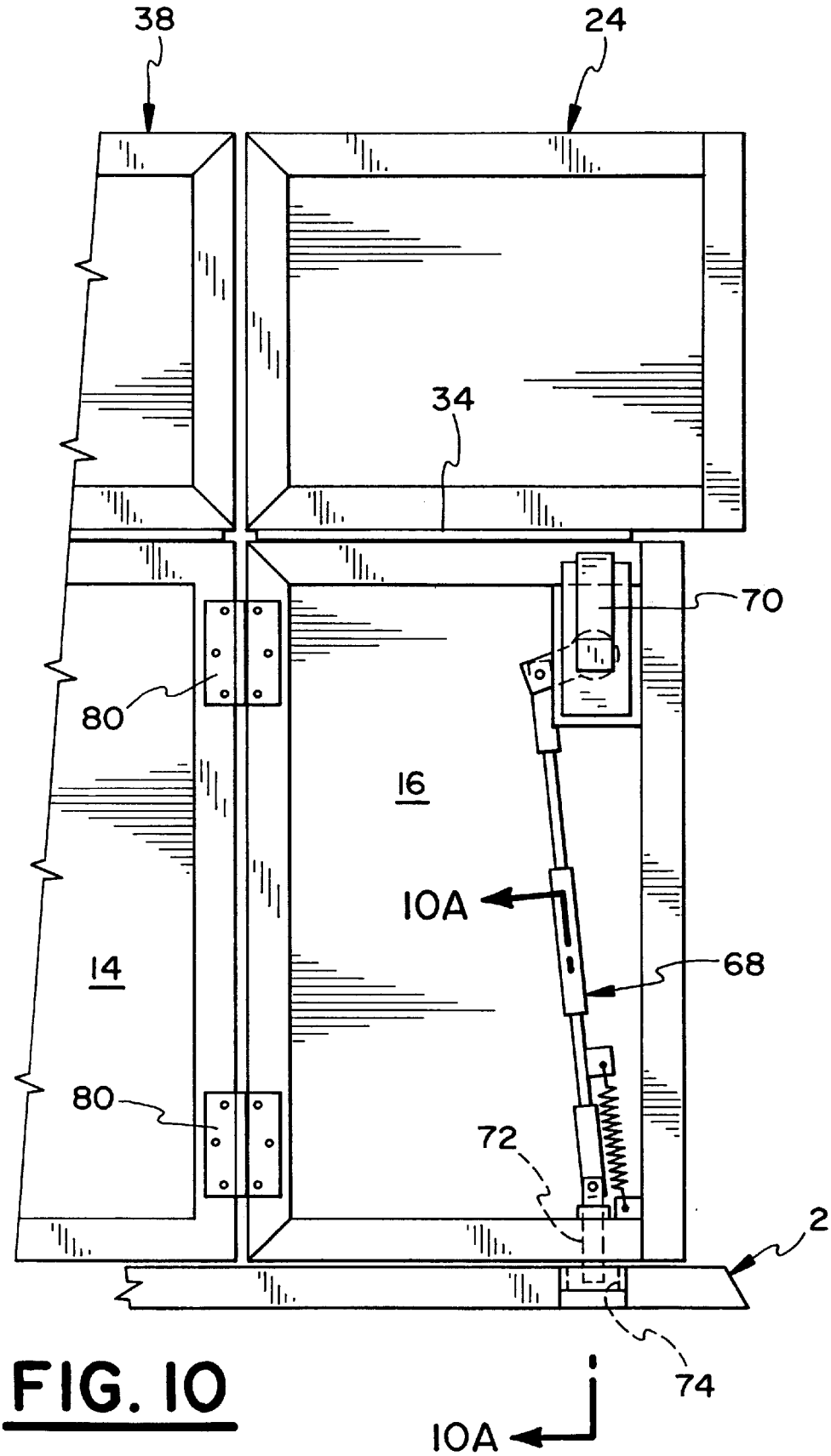
FIG. 10 is a partial sectional view of the front access door latch mechanism taken along lines 10—10 of FIG. 3.

A gas spring device 68 is provided in association with each of the front access doors formed by front corner hand rails section 24 and front corner hand rails section 26 respectively. The gas spring devices 68 function as door latches to secure the doors when in a closed position. FIG. 10 illustrates a gas spring device 68 in connection with front corner hand rail section 24 and associated side panel and frame assembly 16. As can be seen, a hand lever section 70 is provided with associated linkage having a spring bias for lifting a locking pin 72 extending through a recess of frame supporting side panel 16 and into a floor recess 74 extending into platform 2 to thereby lock the door. Unlocking of the door is achieved in the manner shown in FIG. 10B wherein the pin 76 is raised in the direction of the arrow thereby allowing the door to swing open towards the interior of the personnel basket PB. It is within the scope of the present invention to provide other locking mechanisms and latches.

Returning to FIG. 10, hinges 80 are shown to be disposed along edge 32 and between side panel 14 and associated side panel 60 as well as rear corner hand rail section 38 and front corner hand rails section 24. This permits the door to swing inwardly as best shown in FIGS. 7 and 8C whereby access to and from the personnel basket may be achieved through the front of the personnel basket.

FIGS. 11A and 11B illustrate the rotary latch and knob mechanism 82 noted earlier, the latch and knob mechanism provided for locking of both the front corner handrails 24 and 26 and the rear corner handrails 36 and 38 when in an unfolded or upright position. FIG. 11A shows a latch 82 secured to a bottom edge 84 of rear corner hand rail section 38. A cooperating latchbolt 86 is extends from rear panel 20. Rotation of the latch allows the latchbolt 86 to be freed from the U-shaped portion 88 of rotary latch and knob mechanism 82 thereby allowing rear corner hand rail section 38 to swing downwardly for purposes of folding the platform and upwardly for purposes of extending the hand rails in the direction as shown by arrow 90. As noted earlier, similar rotary latch and knob mechanisms are provided for the remaining rear corner handrail 36 as well as the front corner handrails 24 and 26. Other latching mechanisms are within the scope of the present invention so long as the locking mechanism selected secures the panels in a rigid manner and is sufficiently strong so as to withstand forces generated during use without undoing of the latch mechanisms during operation.

U-shaped door rails 44 and 48 are provided with hinge mechanisms and each extends along respective edges 46 and 50 for preventing or allowing access into the personnel basket from the ladder side or rear of the personnel basket PB and through doorway 22. Locking latches or other mechanisms for securing the hand rails into a closed position shown in FIG. 1 may be provided. FIG. 7 illustrates rotation of each door rail 44 and 48 about the respective hinge mechanisms 42 and 50 along the direction of arrow 92.

FIGS. 8A, 8B and 8C illustrate three positions of the personnel basket PB when in use. FIG. 8A shows the front corner hand rail sections, rear corner hand rail sections and control panel in a fully folded position immediately prior to raising of the handrails. When in this folded position, the personnel basket has a reduced height that permits positioning of the personnel basket onto the top of the vehicle cab and out of the line-of-sight of the vehicle driver. This is best shown in FIG. 9 wherein a vehicle VH provided with a ladder LD including personnel basket PB in shown with the handrails in a folded position and with the personnel basket stored on the roof of the cab CB in a manner that will not obstruct the driver's line-of-sight yet also not unduly increase the overall height of the vehicle VH.

Returning to FIG. 8B, the personnel basket PB is shown with the handles fully deployed and in a raised position whereas FIG. 8C shows the front access doors of the personnel basket opened to allow access to the interior of the basket.

It can be seen from the above that the present invention provides a personnel basket for rescue operations having both entry and exit doors that do not require additional or extended setup time prior to use. Accordingly, the present invention provides not only the existence of doors at the front of the personnel basket but folding handrails at as well. The personnel basket PB may now reposition over the top of the cab, potentially decreasing the overall length of the vehicle or allowing for additional storage space without changing the overall length of the vehicle.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A personnel basket adapted for support by a ladder, said basket comprising:

a) a platform, said platform having a front wall, a rear wall and at least one side wall, each of said walls extending perpendicular to said platform to provide a first enclosed region of said platform;

b) a guard rail member, said guard rail member comprising a front rail wall, a rear rail wall and at least one side rail wall, said guard rail member is substantially coextensive with said front wall, said rear wall and said at least one side wall, said at least one side rail wall is pivotally mounted about said at least one side wall so that said guard rail member may be selectively moved to a folded position whereby said at least one side rail wall extends transverse to said at least one side wall and each of said front rail wall and said rear rail wall respectively overly said front wall and said rear wall, further including:

c) a second front wall, a second rear wall, and a second side wall, each of said second front wall, said second rear wall, and said second side wall extend perpendicular to said platform to provide a second enclosed region of said platform, said second enclosed region is a mirror image of said first enclosed region so as to provide a perimeter of walls extending along said platform;

d) A second guard rail member, said second guard rail member comprising a second front rail wall, a second rear rail wall, and a second side rail wall, said second guard rail member is substantially coextensive with said second front wall, said second rear wall, and said second side wall, said second side rail wall is pivotally mounted about said second side wall so that said second guard rail member may be selectively moved to a folded position whereby said second side rail wall extends transverse to said second side wall and each of said front rail wall and said second rear rail wall respectively overly said second front wall and said second rear wall.

2. A personnel basket as in claim 1 and further including:

a) a front door for providing access to said enclosed region, said front door comprising a portion of said front wall and said at least one side wall and is adapted to pivot about an axis between an open position and a closed position.

3. A personnel basket as in claim 2 and wherein:

a) said front door is hingedly secured to a second portion of said at least one side wall.

4. A personnel basket as in claim 3 and further including:

a) a latch for locking said front door when in a closed position, said latch is operably associated with said front door and said platform.

5. A personnel basket as in claim 1 and further including:

a) a second front door for providing access to said second enclosed region, said second front door comprising a portion of said second front wall and said second side wall and is adapted to pivot about an axis thereof between an open position and a closed position.

6. A personnel basket as in claim 5 and wherein:

a) said second front door is hingedly secured to a second portion of said second side wall.

7. A personnel basket as in claim 5 and further including:

a) a latch for locking said second front door when in a closed position, said latch is operably associated with said second front door and said platform.

8. A personnel basket as in claim 1 and further including:

a) a third front wall extending between each of said first front wall and said second front wall and coextensive therewith; and b) a front panel member, said front panel member is hingedly secured to said third front wall to allow said front panel member to be selectively moved to a folded position whereby said panel member extends transverse to said third front wall.

9. A personnel basket as in claim 8 and wherein:

a) said front panel member is adapted to receive controls for operating said personnel basket.

10. A personnel basket as in claim 1 and further including:

a) a doorway, said doorway extending between said rear wall and said second rear wall.

11. A personnel basket as in claim 10 and further including:

a) a pair of doorway rails, a separate one of each of said pair of doorway rails is pivotally secured to said rear rail wall and said second rear rail wall whereby said pair of doorway rails may be selectively positioned to extend into said doorway.

12. A personnel basket adapted for support by a ladder, said basket comprising:

a) a platform, said platform having a front wall, a rear wall and at least one side wall, each of said walls extending perpendicular to said platform to provide a first enclosed region of said platform;

b) a guard rail member, said guard rail member comprising a front rail wall, a rear rail wall and at least one side rail wall, said guard rail member is substantially coextensive with said front wall, said rear wall and said at least one side wall, side at least one side rail wall is pivotally mounted about said at least one side wall so that said guard rail member may be selectively moved to a folded position whereby said at least one side rail wall extends transverse to said at least one side wall and each of said front rail wall and said rear rail wall respectively overly said front wall and said rear wall; and c) a front door for providing access to said enclosed region, said front door comprising a portion of said front wall and said at least one side wall and is adapted to pivot about an axis thereof between an open position and a closed position.

13. A personnel basket as in claim 12 and wherein:

a) said front door is hingedly secured to a second portion of said at least one side wall.

14. A personnel basket as in claim 13 and further including:

a) a latch for locking said front door when in a closed position, said latch is operably associated with said front door and said platform.

15. A personnel basket as in claim 12 and further including:

a) a second front wall, a second rear wall and a second side wall, each of said second front wall, said second rear wall and said second side wall extend perpendicular to said platform to provide a second enclosed region of said platform, said second enclosed region is a mirror image of said first enclosed region so as to provide a perimeter of walls extending along said platform;

b) a second guard rail member, said second guard rail member comprising a second front rail wall, a second rear rail wall and a second side rail wall, said second guard rail member is substantially coextensive with said second front wall, said second rear wall and said second side wall, said second side rail wall is pivotally mounted about said second side wall so that said second guard rail member may be selectively moved to a folded position whereby said second side rail wall extends transverse to said second side wall and each of said second front rail wall and said second rear rail wall respectively overly said second front wall and said second rear wall.

16. A personnel basket as in claim 15 and further including:

a) a second front door for providing access to said second enclosed region, said second front door comprising a portion of said second front wall and said second side wall and is adapted to pivot about an axis thereof between an open position and a closed position.

17. A personnel basket as in claim 16 and wherein:

a) said second front door is hingedly secured to a second portion of said second side wall.

18. A personnel basket as in claim 17 and further including:

a) a latch for locking said second front door when in a closed position, said latch is operably associated with said second front door and said platform.

19. A personnel basket as in claim 15 and further including:

a) a third front wall extending between each of said first front wall and said second front wall and coextensive therewith; and b) a front panel member, said front panel member is hingedly secured to said third front wall to allow said front panel member to be selectively moved to a folded position whereby said panel member extends transverse to said third front wall.

20. A personnel basket as in claim 19 and wherein:

a) said front panel member is adapted to receive controls for operating said personnel basket.

21. A personnel basket as in claim 15 and further including:

a) a doorway, said doorway extending between said rear wall and said second rear wall.

22. A personnel basket as in claim 21 and further including:

a) a pair of doorway rails, a seperate one of each of said pair of doorway rails is pivotally secured to said rear rail wall and said second rear rail wall whereby said pair of doorway rails may be selectively positioned to extend into said doorway.

* * * * *